US010675736B1

(12) United States Patent
Boutorine

(10) Patent No.: US 10,675,736 B1
(45) Date of Patent: Jun. 9, 2020

(54) ANGLE REFERENCE APPARATUS FOR SHARPENING BLADES

(71) Applicant: Oleg Boutorine, Brooklyn, NY (US)

(72) Inventor: Oleg Boutorine, Brooklyn, NY (US)

( * ) Notice: Subject to any disclaimer, the term of this patent is extended or adjusted under 35 U.S.C. 154(b) by 0 days.

(21) Appl. No.: 16/573,956

(22) Filed: Sep. 17, 2019

(51) Int. Cl.
*B24D 15/06* (2006.01)

(52) U.S. Cl.
CPC ..... *B24D 15/06* (2013.01)

(58) Field of Classification Search
CPC ..... B24D 15/06; B24D 15/08; B24D 15/081; B24D 15/084; B24D 15/063; B24B 3/54
See application file for complete search history.

(56) References Cited

U.S. PATENT DOCUMENTS 2,652,667 A * 9/1953 Arnold ..... B24D 15/08 451/555
4,558,540 A * 12/1985 Collins ..... B24D 15/08 451/555
9,033,771 B2 * 5/2015 Krent ..... B24D 15/08 451/540
9,039,494 B1 * 5/2015 Dovel ..... B24D 15/08 451/349

* cited by examiner

*Primary Examiner* — Dung Van Nguyen
(74) *Attorney, Agent, or Firm* — Changi Wu; Changi Wu Law Office

(57) ABSTRACT

An angle reference apparatus for sharpening a blade on a sharpening surface of a sharpening tool comprises at least one angle guide having a guide surface and a bottom surface, wherein the guide surface has a predetermined angle between about 0 degrees to about 89 degrees relative to the bottom surface; and at least one base; wherein the at least one angle guide can be disposed on the at least one base; wherein the base can be disposed on the sharpening surface or alternatively the base can be disposed on a surface adjacent to the sharpening tool; wherein the blade can be placed on the guide surface of the angle guide; wherein the angle reference apparatus is substantially stationary to the sharpening surface when the blade is moved on the sharpening surface.

14 Claims, 6 Drawing Sheets

ANGLE REFERENCE APPARATUS FOR SHARPENING BLADES

CROSS-REFERENCE RELATED TO RELATED APPLICATIONS

None.

BACKGROUND

For sharpening knives, it is very important to keep a constant angle at which blade contacts sharpening device. Changing angle will result in mis-sharpening or damaging blade edge. Sharpening devices such as sharpening or honing stones may have integrated angle guides, such as disclosed, for example, in U.S. Pat. Nos. 4,094,106; 4,197,677; 6,048,262; and 9,033,771. However, different knives have different shapes and need to be sharpened at different angles between the knife blade surface and the surface of the sharpening tool. Those disclosed sharpening guides or sharpening tools with angle guides have fixed guide angles. Therefore, a user will need multiple sharpening tools with different angles when the user has different knife blades to be sharpened.

Another issue of the disclosed sharpening tools with fixed angle guide is that their angle guides cannot be repositioned to another section of the sharpening tool when the section of the sharpening tool adjacent to the fixed angle guide has been worn out. Thus, the sharpening tools with fixed angle guide are inconvenient, cost-ineffective, and need large spaces to store multiple sharpening tools.

Furthermore, a sharpening tool, such as a sharpening stone, maybe in different height or be held by holders that have different height. An angle guide is best to be at the same level as the sharpening surface of the sharpening tool. Therefore, it is inconvenient as the traditional angle guide that has a fixed height.

BRIEF SUMMARY OF THE INVENTION

This Brief Summary is included so as to introduce, in an abbreviated form, various topics to be elaborated upon below in the Detailed Description. This Brief Summary is not intended to identify key or essential aspects of the claimed invention. This Brief Summary is similarly not intended for use as an aid in determining the scope of the claims. The current invention is directed to an angle reference apparatus for sharpening a blade on a sharpening surface of a sharpening tool which comprises at least one angle guide having a guide surface and a bottom surface, wherein the guide surface has a predetermined angle between about 0 degrees to about 89 degrees relative to the bottom surface; and at least one base; wherein the at least one angle guide can be disposed on the at least one base; wherein the base can be disposed on the sharpening surface or alternatively the base can be disposed on a surface adjacent to the sharpening tool; wherein the blade can be placed on the guide surface of the angle guide; wherein the angle reference apparatus is substantially stationary to the sharpening surface when the blade is moved on the sharpening surface.

BRIEF DESCRIPTION OF THE DRAWINGS

It should be understood that the drawings are merely representative, are not necessarily drawn to scale, and are not intended to limit the subject matter of this application.

DETAILED DESCRIPTION

Figure 1:
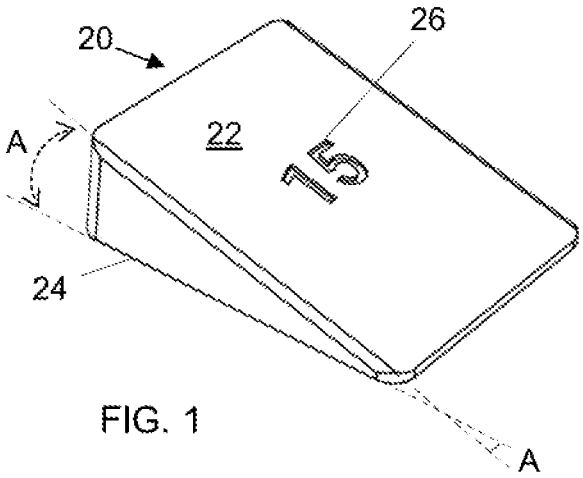
FIG. 1 is a perspective view of one preferred embodiment of an angle guide.

Before the present invention is described in greater detail, it is to be understood that this invention is not limited to particular embodiments described, and as such may, of course, vary. It is also to be understood that the terminology used herein is for the purpose of describing particular embodiments only, and is not intended to be limiting since the scope of the present invention will be limited only by the appended claims.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Other than in the embodiment or example, or where indicated otherwise, all numbers indicating ingredient quantities and/or reaction conditions are to be understood as being modified in every instance by the word "about," which means the ingredient quantities or reaction conditions are within 10 percent to 15 percent of the indicated value.

Unless defined otherwise, all terms used herein have the same meaning as commonly understood by one of ordinary skill in the art to which this invention belongs. Although any methods and materials similar or equivalent to those described herein can be used in the practice or testing of the present invention, some potential and exemplary methods and materials may now be described. Any and all publications mentioned herein are incorporated herein by reference to disclose and describe the methods and/or materials in connection with which the publications are cited. It is understood that the present disclosure supersedes any disclosure of an incorporated publication to the extent there is a contradiction.

It must be noted that as used herein and in the appended claims, the singular forms "a", "an", and "the" may also include the plural referents unless the context clearly dictates otherwise.

It is further noted that the claims may be drafted to exclude any element that may be optional. As such, this statement is intended to serve as antecedent basis for use of such exclusive terminology as "solely", "only" and the like in connection with the recitation of claim elements, or the use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention.

Figure 10A:
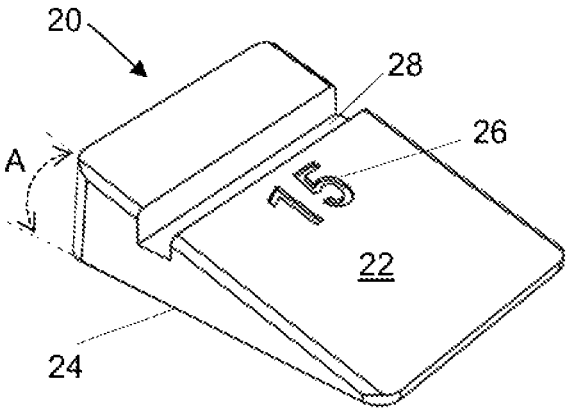
FIG. 10*a* is a perspective view of the top of one preferred embodiment of an angle guide.
Figure 10B:
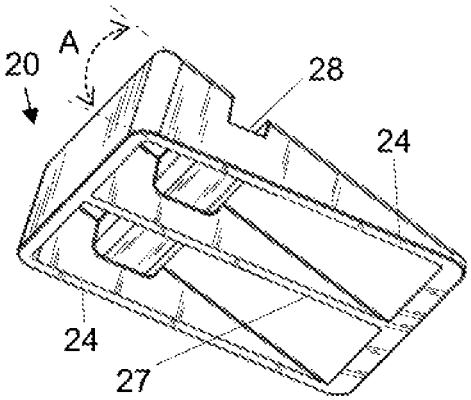
FIG. 10*b* is a perspective view of the bottom (hollow) of one preferred embodiment of an angle guide.
Figure 10C:
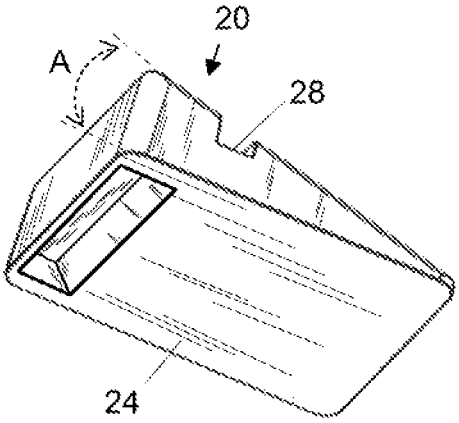
FIG. 10*c* is a perspective view of the bottom (solid) one preferred embodiment of an angle guide.

As shown in FIG. 1, FIG. 10*b*, and FIG. 10*c*, a preferred embodiment of an angle guide 20 having a guide surface 22 and a bottom surface 24, wherein the guide surface 22 has a predetermined angle A between about 0 degrees to about 89 degrees relative to the bottom surface 24. A preferred embodiment of the angle guide may optionally have an angle mark 26, printed, engraved, or molded, to show the predetermined angle A for a user's easy recognition of the degree of the angle guide. An angle reference apparatus may have many angle guides, which each of them may have a predetermined angle so that users can choose an angle guide that is appropriate for each sharpened blade. There are more variations of the angle reference apparatus that provide more combinations of multiple angle guides in one angle reference apparatus, which will be disclosed in the latter part of the detailed descriptions.

As shown in FIG. 2, FIG. 5, FIG. 6, and FIG. 12, a preferred embodiment of a base 30 which comprises at least one stand 50 and a stand shoe 60, wherein the stand shoe 60 further comprises a top 62 and a bottom 64 opposite to the top 62, wherein the at least one stand 50 can be disposed on the stand shoe 60. In one preferred embodiment, the stand shoe 60 further comprise a retaining wall 66 extending upwardly from the top 62 of the stand shoe 60, wherein the retaining wall 66 is fully or partially around a circumference 69 of the top 62 of the stand shoe 60, and wherein the at least one stand 50 can be secured against the retaining wall 66 when the at least one stand 50 is disposed on the top 62 of the stand shoe 60. In one preferred embodiment, a stand 50 further comprising a retaining wall 58 extending upwardly from the top 52 of the stand 50, wherein the retaining wall 58 is fully or partially around a circumference 59 of the top 52 of the stand 50, and wherein the at least one angle guide 20 or another one of the at least on stand 50 can be secured against the retaining wall 58 when the at least one angle guide 20 or another one of the at least on stand 50 is disposed on the top of the stand 50. In one preferred embodiment, at least one retaining rib 57 extending upwardly from the top 52 of the stand 50 to further secure an angle guide 20 or a stand 50 on the top of a stand 50. In one preferred embodiment, the stand shoe 60 comprises an anti-slip material, such as, but not limited to, rubbers, silicones, abrasives, and soft plastics. The anti-slip material can prevent the angle reference apparatus from moving when a blade 100 is placed against the guide surface 22 of the angle guide 20.

Figure 2:
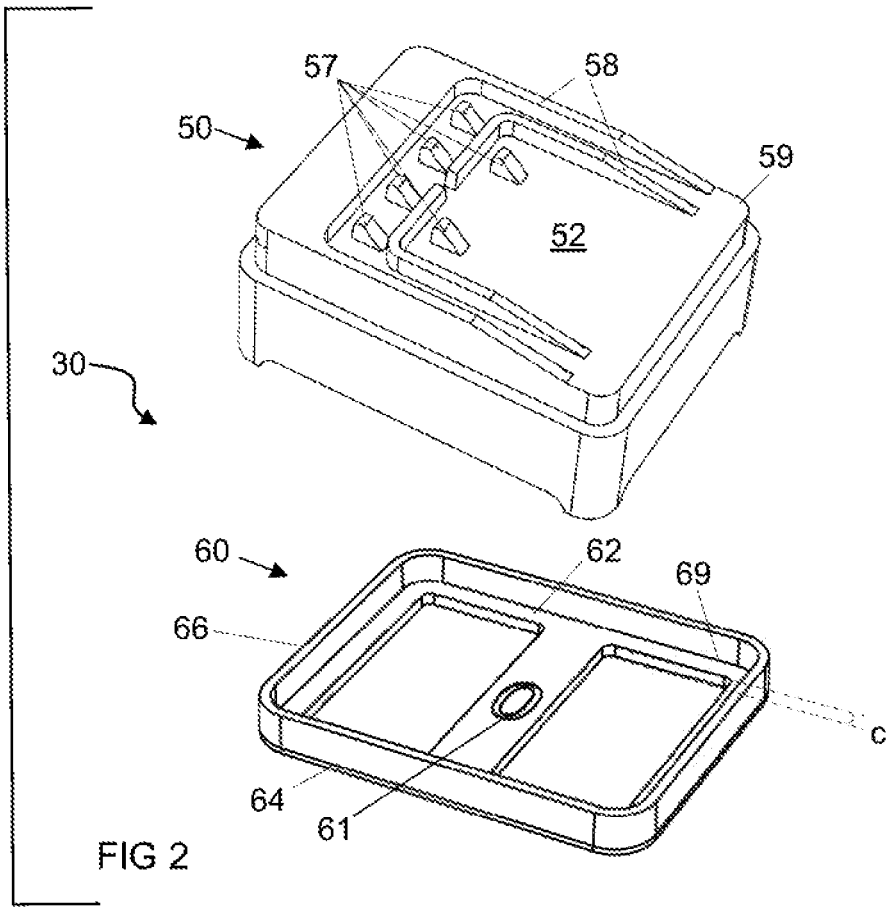
FIG. 2 is a perspective, exploded view of one preferred embodiment of a stand and a stand shoe.

As shown in FIG. 2, in one preferred embodiment, the top 62 the stand shoe 60 has a predetermined angle c about 0 degrees to about 89 degrees formed between the top 62 and the bottom 64 of the stand shoe 60.

As shown in FIG. 2, in one preferred embodiment, the stand shoe 60 may optionally have an angle mark 61, printed, molded, or engraved, to show the predetermined angle c for a user's easy recognition of the degree of the angle stand shoe. The predetermined angle c can be about 0 degrees to about 90 degrees but preferred to be 0 degrees or 1 degree.

Figure 3:
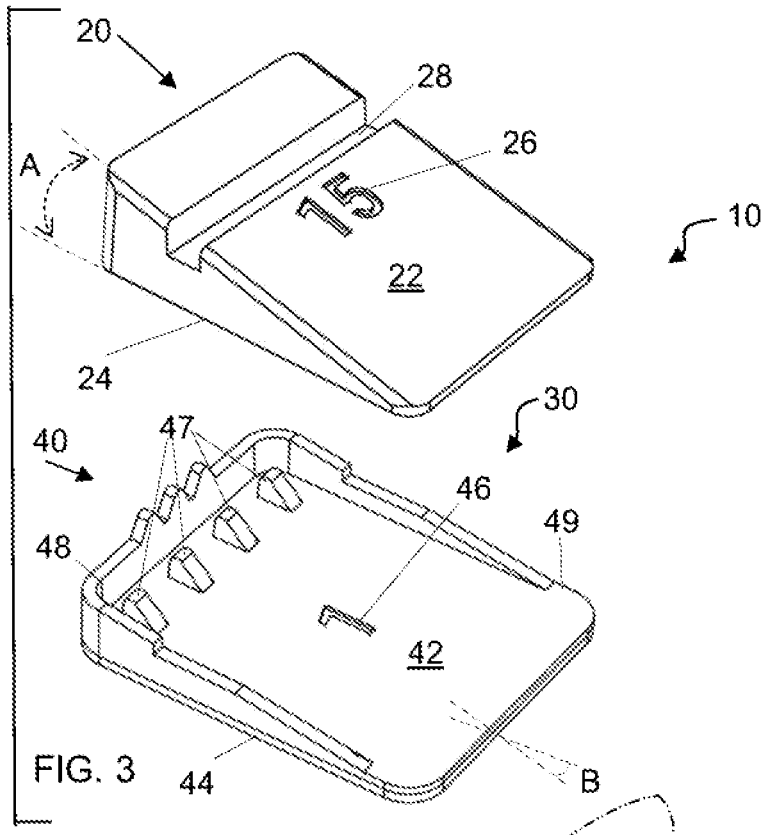
FIG. 3 is a perspective, exploded view of one preferred embodiment of an angle guide and an angle guide shoe.
Figure 4:
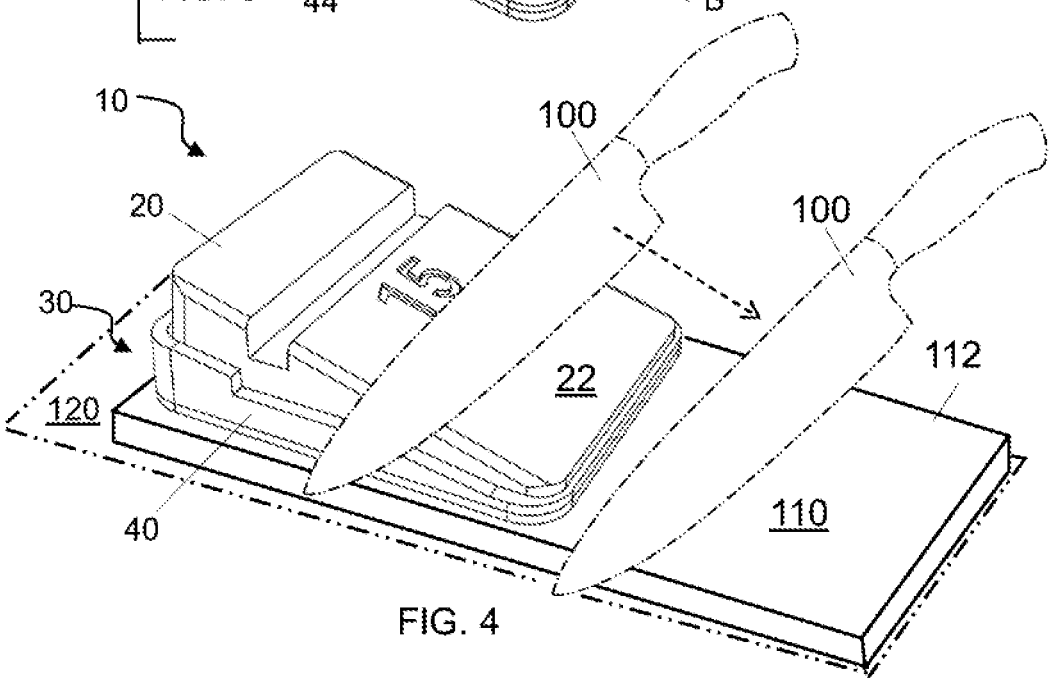
FIG. 4 is a perspective view showing one preferred embodiment of an angle reference apparatus.

As shown in FIG. 1, FIG. 3 and FIG. 4, in one preferred embodiment of an angle reference apparatus 10 for sharpening a blade 100 on a sharpening surface 110 of a sharpening tool 112, the angle reference apparatus 10 comprises at least one angle guide 20 having a guide surface 22 and a bottom surface 24, wherein the guide surface 22 has a predetermined angle A between about 0 degrees to about 89 degrees relative to the bottom surface 24; and at least one base 30; wherein the at least one angle guide 20 can be disposed on the at least one base 30; wherein the base 30 can be disposed on the sharpening surface 110 or alternatively the base 30 can be disposed on a surface 120, such as a table surface, adjacent to the sharpening tool 112; wherein the blade 100 can be placed on the guide surface 22 of the angle guide 20; wherein the angle reference apparatus 10 is substantially stationary to the sharpening surface 110 when the blade 100 is moved on the sharpening surface 110. Because different angle guide 20 can have different angle A, a user can choose the angle guide 20 suitable for sharpening the blade 100. Furthermore, the angle reference apparatus 10 is not fixed on the sharpening surface; therefore, it is convenient for the user to reposition the angle reference apparatus 10 on to another sharpening surface.

As shown in FIG. 4, the operation of the angle reference apparatus 10 is different from some of the sharpening guides that are moved along with the movement of a blade when a blade is against a sharpening guide by a user sharpening a blade on a sharpening tool. Instead, in the present invention, a user sharpening a blade 100 on the angle reference apparatus 10 can place the blade 100 on the angle guide 20 of the angle reference apparatus 10 to get a reference angle initially. The user can use muscle memory to keep the angle consistently and then to move the blade 100 forward along the sharpening surface 110, on which the blade 100 leaving the guide surface 22 of the angle guide 20. The benefit of the present invention is that its simplicity of mechanical parts has a longer useful life than those sharpening guide tools that have moving angle guide that needs complicate moving mechanical parts, much harder to use and is easy to fail.

In one preferred embodiment, as shown in FIGS. 3 and 4, the base 30 comprises an angle guide shoe 40, wherein the angle guide shoe 40 further comprises a top 42, and a bottom 44 opposite to the top 42, and wherein the angle guide shoe 40 can be disposed on a sharpening surface 110 or alternatively the angle guide shoe 40 can be disposed on a surface 120, such as a table surface, adjacent to the sharpening surface 110. In one preferred embodiment, the angle guide shoe 40 comprises an anti-slip material, such as, but not limited to, rubbers, silicones, abrasives, and soft plastics.

As shown in FIG. 3, one preferred embodiment of the angle guide shoe 40 further comprises a retaining wall 48 extending upwardly from the top 42 of the angle guide shoe 40, wherein the retaining wall 48 is fully or partially around a circumference 49 of the top 42 of the angle guide shoe 40, wherein the at least one angle guide 20 can be secured against the retaining wall 48 when the at least one angle guide 20 is disposed on the top 42 of the angle guide shoe 40. As shown in FIG. 3, a preferred embodiment of the angle guide shoe 40 further comprises at least one retaining rib 47 to be, secure the angle guide 20 on the top 42 of the angle guide shoe 40.

As shown in FIG. 3, in one preferred embodiment of the angle guide shoe 40, the top 42 of the angle guide shoe 40 has a predetermined angle B from about 0 degrees to about 89 degrees relative to the bottom 44 of the angle guide shoe 40.

As shown in FIG. 3, in one preferred embodiment, the angle guide shoe 40 may optionally have an angle mark 46, printed, molded, or engraved, to show the predetermined angle B for a user's easy recognition of the degree of the predetermined angle B.

Figure 11:
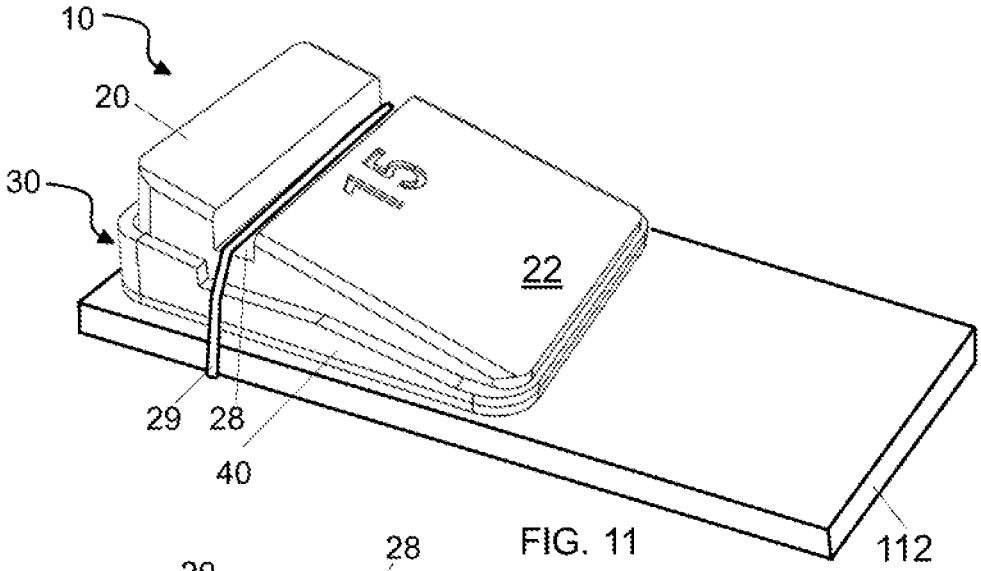
FIG. 11 is a perspective view of one preferred embodiment of an angle reference apparatus tied on a sharpening tool by an elastic band.

As shown in FIG. 3 and FIG. 11, in one preferred embodiment of the angle reference apparatus 10, wherein a groove 28 is formed on the guide surface 22 of the angle guide 20 and wherein an elastic band 29 can be disposed in the groove 28 to wrap the at least one angle guide 20 to the sharpening tool 112. The material of the elastic band can be, but not limited to, rubber, steel, stainless steel, or suitable material that are elastic to be stretched.

As shown in FIG. 2, FIG. 5, FIG. 6, and FIG. 12 in one preferred embodiment of the angle reference apparatus 10, the base 30 comprises at least one stand 50 and a stand shoe 60, wherein the stand shoe 60 further comprises a top 62 and a bottom 64 opposite to the top 62, wherein the at least one stand 50 can be stacked on another of the at least one stand 50, wherein the at least one stand 50 can be disposed on the stand shoe 60, and wherein stand shoe 60 can be disposed on a surface 120 adjacent to the sharpening tool 112. The benefit of the combination of stands is to provide an adjustable height of the base of the angle reference apparatus to fit the various heights of sharpening tools, or to fit a sharpening tool on high or low sharpening holders (not shown). It is a great convenience when angle guide is located at about the same height with the sharpening surface of sharpening stone.

Figure 8:
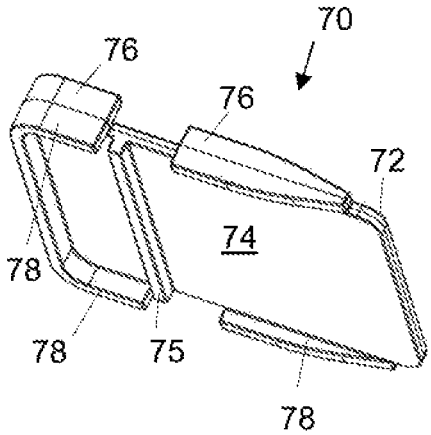
FIG. 8 a perspective view showing the bottom of the coupling.
Figure 9:
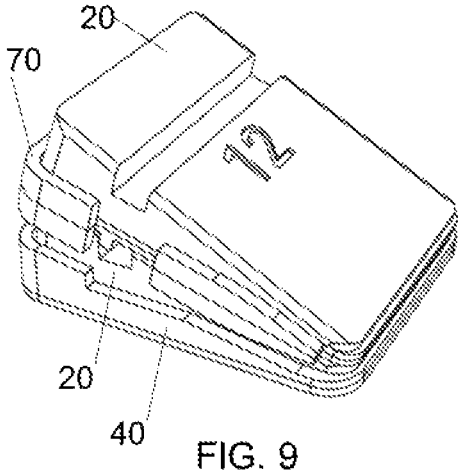
FIG. 9 is a perspective view of one preferred embodiment of two angle guides, a coupling, and an angle guide shoe assembled together.
Figure 7:
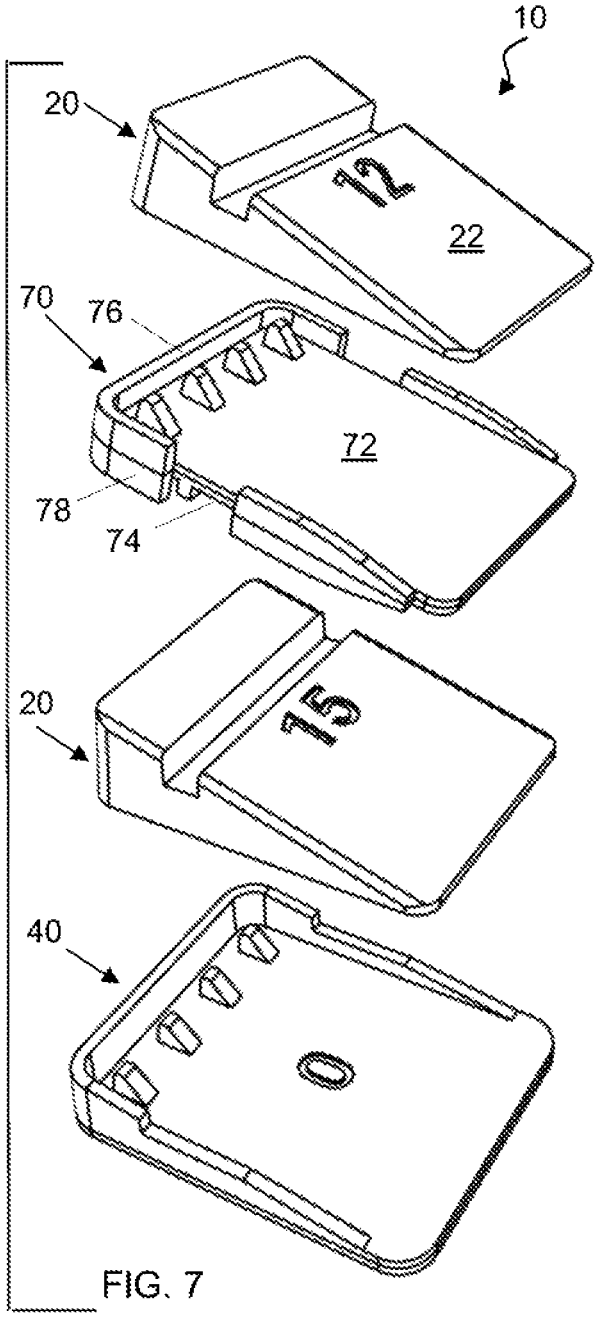
FIG. 7 is a perspective, exploded view of one preferred embodiment of two angle guides, a coupling, and an angle guide shoe.

As shown in FIG. 7, FIG. 8, and FIG. 9, in one embodiment of the angle reference apparatus 10, the angle reference apparatus 10 further comprises a coupling 70 having a top 72, a bottom 74 opposite to the top 72, an upper retaining wall 76 extending upwardly from the top 72, a lower retaining wall 78 extending downwardly from the bottom 74; wherein the bottom 74 of the coupling 70 can be disposed on the guide surface 22 of the at least one angle guide 20; and wherein another of the at least one angle guide 20 can be disposed on the top 72 of the coupling 70.

As shown in FIGS. 10*a*, 10*b*, 10*c*, and 13 in one embodiment, the bottom surface 24 of an angle guide 20 can be hollow and may have panels to reinforce the structure of the angle guide, but in another embodiment of the bottom surface 24 of an angle guide 20 the bottom surface 24 can be solid and have a recessed area for receiving the retaining rib 47 (FIG. 3) of the angle guide shoe 40 or the retaining rib 57 of the stand 50 (FIG. 2). This configuration of solid or hollow bottoms is same for the stand 50 (not shown). A person having ordinary skill of the art shall be able to appreciate the configuration. In addition, the at least one stand may further comprise at least one magnet 51 (FIG. 13) embedded in the stand or attached to the bottom so that the at least one stand can be secured by the at least one magnet to stack on another of the at least one stand. A person having ordinary skill of the art shall be able to appreciate the configuration.

Figure 5:
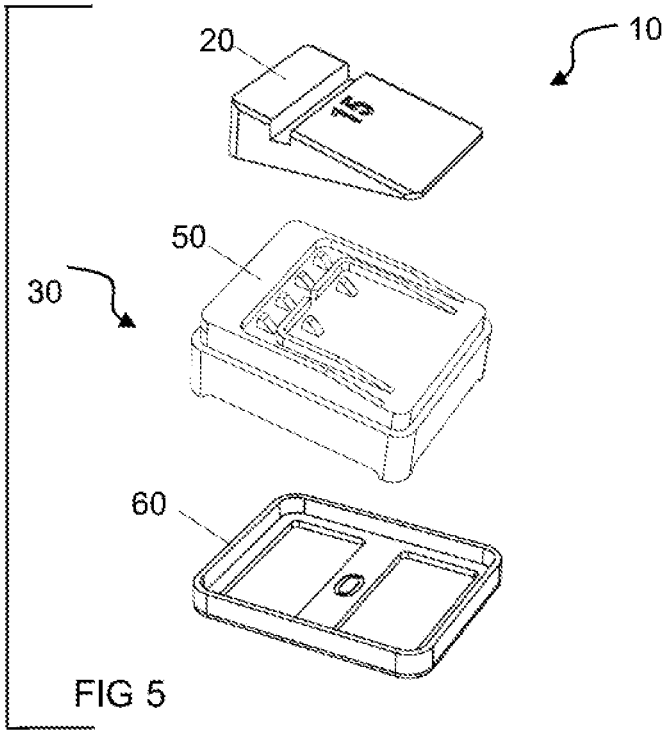
FIG. 5 is a perspective, exploded view of one preferred embodiment of an angle guide, a stand, and a stand shoe.
Figure 6:
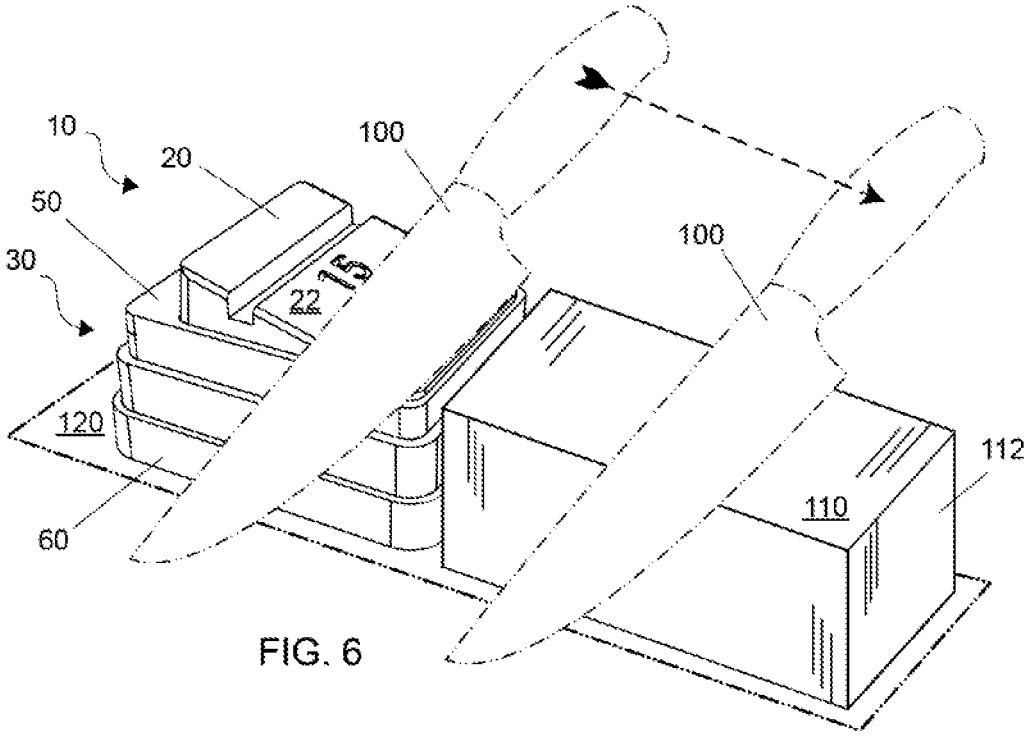
FIG. 6 a perspective view showing another preferred embodiment of an angle reference apparatus.
Figure 12:
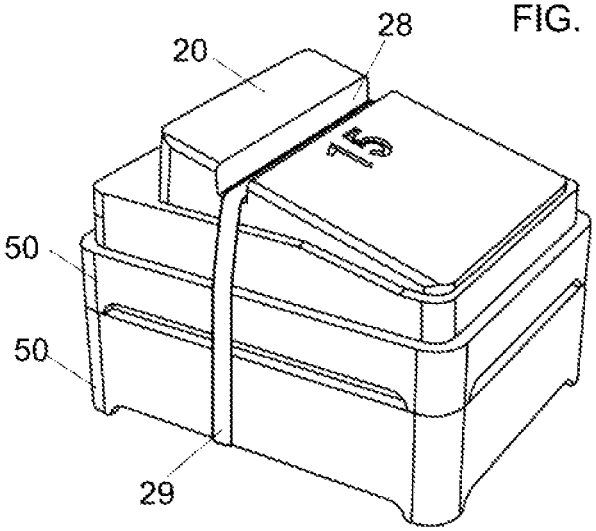
FIG. 12 is a perspective view of one preferred embodiment of one angle guide and two stands stacked together.
Figure 13:
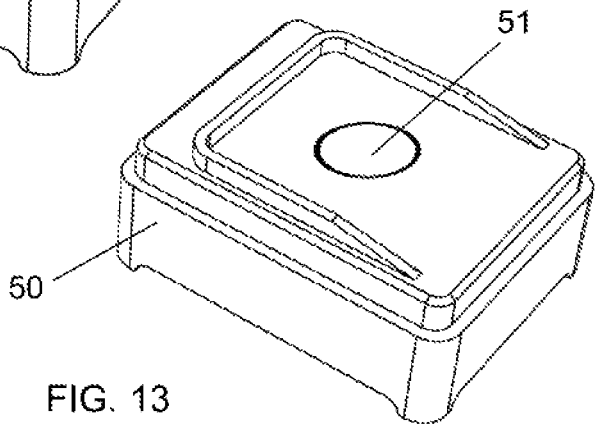
FIG. 13 is a perspective view of one preferred embodiment of stand with a magnet.

As shown in FIG. 5 and FIG. 12, in one preferred embodiment of an angle reference apparatus 10, wherein there are two stands 50 having different height are stacked together, and wherein a groove 28 is formed on the guide surface 22 of the angle guide 20, and wherein an elastic band 29 can be disposed in the groove 28 to wrap the at least one angle guide 20 to the at least one stand 50. The benefit of the stacking of the stands 50 having different heights is that the stacking of stands can result in different combinations of heights to fit the various heights of the sharpening tool, like a sharpening stone, and the holder of the sharpening stone.

Having described the subject matter of the present disclosure detailed description of embodiments and examples for purposes of clarity of understanding to a person having ordinary skill in the art that the same can be performed by modifying or changing the subject matter within various conditions, by various structures and by other parameters without affecting its scope or any specific embodiment thereof, and that such modifications or changes are intended to be encompassed within the scope of the claims.

What claimed is:

1. An angle reference apparatus for sharpening a blade on a sharpening surface of a sharpening tool comprising:

at least one angle guide having a guide surface and a bottom surface, wherein the guide surface has a predetermined angle between about 0 degrees to about 89 degrees relative to the bottom surface; and at least one base;

wherein the at least one angle guide can be disposed on the at least one base;

wherein the base can be disposed on the sharpening surface or alternatively the base can be disposed on a surface adjacent to the sharpening tool;

wherein the blade can be placed on the guide surface of the angle guide; and wherein the angle reference apparatus is substantially stationary to the sharpening surface when the blade is moved on the sharpening surface;

wherein the base comprises an angle guide shoe, wherein the angle guide shoe further comprises a top, and a bottom opposite to the top, and wherein the angle guide shoe can be disposed on a sharpening surface or alternatively the angle guide shoe can be disposed on a surface adjacent to the sharpening tool.

2. The angle reference apparatus of claim 1, wherein the angle guide shoe further comprises an anti-slip material.

3. The angle reference apparatus of claim 1, wherein the angle guide shoe further comprises a retaining wall extending upwardly from the top of the angle guide shoe, wherein the retaining wall is fully or partially around a circumference of the top of the angle guide shoe, and wherein the at least one angle guide can be secured against the retaining wall when the at least one angle guide is disposed on the top of the angle guide shoe.

4. The angle reference apparatus of claim 1, wherein the top of the angle guide shoe has a predetermined angle from about 0 degrees to about 89 degrees relative to the bottom of the angle guide shoe.

5. The angle reference apparatus of claim 1, wherein a groove is formed on the guide surface of the angle guide, and wherein an elastic band can be disposed in the groove to wrap the at least one angle guide to the sharpening tool.

6. The angle reference apparatus of claim 1, further comprising a coupling having a top, a bottom opposite to the top, an upper retaining wall extending upwardly from the top, a lower retaining wall extending downwardly from the bottom;

wherein the bottom of the coupling can be disposed on the guide surface of the at least one angle guide; and wherein another of the at least one angle guide can be disposed on the top of the coupling.

7. An angle reference apparatus for sharpening a blade on a sharpening surface of a sharpening tool comprising:

at least one angle guide having a guide surface and a bottom surface, wherein the guide surface has a predetermined angle between about 0 degrees to about 89 degrees relative to the bottom surface; and at least one base;

wherein the at least one angle guide can be disposed on the at least one base;

wherein the base can be disposed on the sharpening surface or alternatively the base can be disposed on a surface adjacent to the sharpening tool;

wherein the blade can be placed on the guide surface of the angle guide; and wherein the angle reference apparatus is substantially stationary to the sharpening surface when the blade is moved on the sharpening surface;

wherein the base comprises at least one stand and a stand shoe, wherein the stand shoe further comprises a top and a bottom opposite to the top, wherein the at least one stand can be stacked on another of the at least one stand, wherein the at least one stand can be disposed on the stand shoe, and wherein the stand shoe can be disposed on a sharpening surface or alternatively the stand shoe can be disposed on a surface adjacent to the sharpening tool.

8. The angle reference apparatus of claim 7, wherein the stand shoe further comprises an anti-slip material.

9. The angle reference apparatus of claim 7, wherein the stand further comprising a retaining wall extending upwardly from the top of the stand, wherein the retaining wall is fully or partially around a circumference of the top of the stand, and wherein the at least one angle guide can be secured against the retaining wall when the at least one angle guide is disposed on the top of the stand.

10. The angle reference apparatus of claim 7, wherein the stand shoe further comprising a retaining wall extending upwardly from the top of the stand shoe, wherein the retaining wall is fully or partially around a circumference of the top of the stand shoe, and wherein the at least one stand can be secured against the retaining wall when the at least one stand is disposed on the top of the stand shoe.

11. The angle reference apparatus of claim 7, wherein the top of the stand shoe has a predetermined angle about 0 degrees to about 89 degrees relative to the bottom of the stand shoe.

12. The angle reference apparatus of claim 7, wherein a groove is formed on the guide surface of the angle guide, and wherein an elastic band can be disposed in the groove to wrap around the at least one angle guide to the at least one stand.

13. The angle reference apparatus of claim 7, wherein the at least one stand further comprises at least one magnet, wherein the at least one stand can be secured by the at least one magnet to stack on another of the at least one stand.

14. The angle reference apparatus of claim 7, further comprising a coupling having a top, a bottom opposite to the top, an upper retaining wall extending upwardly from the top, a lower retaining wall extending downwardly from the bottom;

wherein the bottom of the coupling can be disposed on the guide surface of the at least one angle guide; and wherein another of the at least one angle guide can be disposed on the top of the coupling.

* * * * *